United States Patent [19]

Niskanen

[11] Patent Number: 4,834,547

[45] Date of Patent: May 30, 1989

[54] APPARATUS FOR MIXING CHEMICALS IN FIBRE SUSPENSIONS

[75] Inventor: Toivo Niskanen, Hamina, Finland

[73] Assignee: A. Ahlstrom Corporation, Karhula, Finland

[21] Appl. No.: 62,964

[22] PCT Filed: Jul. 9, 1986

[86] PCT No.: PCT/FI86/00080

§ 371 Date: Mar. 10, 1987

§ 102(e) Date: Mar. 10, 1987

[87] PCT Pub. No.: WO87/00448

PCT Pub. Date: Jan. 29, 1987

[30] Foreign Application Priority Data

Jul. 9, 1986 [FI] Finland ..... 86/00080

[51] Int. Cl.[4] ..... B01F 15/02

[52] U.S. Cl. ..... 366/165; 366/150; 366/171; 366/176; 55/203

[58] Field of Search ..... 55/203, 21, 52, 190, 55/409; 366/150, 165, 167, 168, 169, 171, 173, 176, 177, 263, 264, 270, 279, 317; 162/55

[56] References Cited

U.S. PATENT DOCUMENTS

| | | | |
|---|---|---|---|
| 1,683,500 | 9/1928 | Thordarson | 366/171 |
| 3,290,864 | 12/1966 | Harker et al. | 55/203 |
| 4,093,506 | 6/1978 | Richter | 366/165 |
| 4,172,668 | 10/1979 | Thompson et al. | 366/176 |
| 4,339,206 | 7/1982 | Ahs . | |
| 4,410,337 | 10/1983 | Gullichsen et al. | 55/203 |
| 4,435,193 | 10/1984 | Gullichsen et al. . | |
| 4,671,665 | 6/1987 | McIntire | 366/165 |

FOREIGN PATENT DOCUMENTS 1102604 1/1981 Canada .

OTHER PUBLICATIONS

PCT Publication WO81/00815.

*International Technology Disclosures* article entitled "Mixing Steam and/or Chemicals into a Fiber Suspension", vol. 1, No. 9, dated Jul. 25, 1983.

*Primary Examiner*—Harvey C. Hornsby
*Assistant Examiner*—Christine A. Peterson
*Attorney, Agent, or Firm*—Nixon & Vanderhye

[57] ABSTRACT

The invention relates to an apparatus for mixing chemicals in fibre suspensions. The apparatus comprises a rotor (8) provided with blades and mounted to rotate in a casing (1) having an inlet (3) and an outlet (5) for the fibre suspension; and an inlet or inlets (6) for chemicals. The rotor (8) comprises a fluidizing and gas separating section (9), a pumping section (10) and a section (12) for mixing chemicals. An inlet (25) for chemicals leads to a space (24) between the pumping section (10) and the mixing section (12). The blades of the mixing section preferably cooperate with the casing wall (17) provided with ribs (18).

7 Claims, 3 Drawing Sheets

A - A

APPARATUS FOR MIXING CHEMICALS IN FIBRE SUSPENSIONS

TECHNICAL FIELD

The present invention relates to an apparatus for mixing chemicals in fibre suspensions, particularly in high consistency cellulose pulps. The chemicals to be mixed in the pulp can be in a gaseous or liquid form.

Various devices are used in pulp industry for mixing chemicals in pulps. When the consistency is low, i.e. up to approximately 5%, mixing does not usually cause problems. At higher consistencies, e.g. 5–15%, mixing is, however, more difficult as the gas content, mostly air content, of the pulp increases with the rise of the consistency and only little liquid remains between the fibres. The air in the pulp interferes with the reaction of the chemicals and aggravates pumping of the pulp with a centrifugal pump.

BACKGROUND ART

Swedish patent application No. 7909781-2 discloses an apparatus for mixing treatment chemicals in suspensions. The apparatus comprises a mixing means consisting of a cylindrical portion provided with axial ribs, and of a larger discshaped portion provided with radial ribs. The housing of the apparatus is provided with corresponding stationary ribs. When the mixing means rotates the pulp flowing through the passages between the mixing means and the housing is fluidized and chemicals are efficiently mixed in the pulp.

U.S. Pat. No. 4,410,337 discloses an apparatus for separating gas from a fibre suspension, in which the fibre suspension is caused to rotate by a rotor provided with blades and disposed in the inlet channel of the apparatus so as to bring about a core of gas surrounded by fibre suspension, gas being discharged from the core to a separate gas space.

Further, Finnish patent application No. 823279 discloses an apparatus for mixing chemicals in fibre suspensions. The apparatus comprises a rotor provided with external protrusions and disposed in the casing in the inlet channel of the centrifugal pump in front of an impeller. The casing is provided with an opening or openings through which chemicals can be supplied to the space between the inlet channel and the rotor.

Until now at least two devices provided each with its own drive have been required for pumping pulp, removing the harmful gas and mixing chemicals in the pulp.

DISCLOSURE OF THE INVENTION

The primary object of the present invention is to provide an apparatus the construction of which is simple and by which gas can be removed from a high consistency pulp, chemicals can be mixed in the pulp and the pulp can be pumped.

The apparatus makes use of the advantages provided by fluidization in pumping of a pulp and in mixing chemicals in a pulp.

An apparatus according to the invention comprises a rotor provided with blades and mounted to rotate in the casing, an inlet and an outlet for the fibre suspension, and an inlet or inlets for chemicals. It is a characteristic feature of the apparatus that the rotor comprises a fluidizing and gas separating section, a pumping section and a section for mixing chemicals; and that at least one of the inlets for chemicals leads to the space between the pumping section and the mixing section or to the pumping section after the gas separating section or to the mixing section.

As removal of gas from the pulp and mixing chemicals in the pulp can be carried out as consecutive steps in the apparatus used for pumping the pulp, considerable savings are gained in investment, operation and maintenance costs and in the requirement of space when compared to known devices.

As chemicals are mixed in the pulp after gas has been removed, also gaseous and gasifiable chemicals can be mixed in the pulp with this apparatus. Expensive chemicals are thus not lost in connection with the gas removal. If chemicals are added to the pulp after pumping, e.g. gaseous chemicals do not disturb pumping.

BRIEF DESCRIPTION OF THE DRAWINGS

The invention is described in detail below with reference to the accompanying drawings in which.

BEST MODE OF CARRYING OUT THE INVENTION

Figure 1:
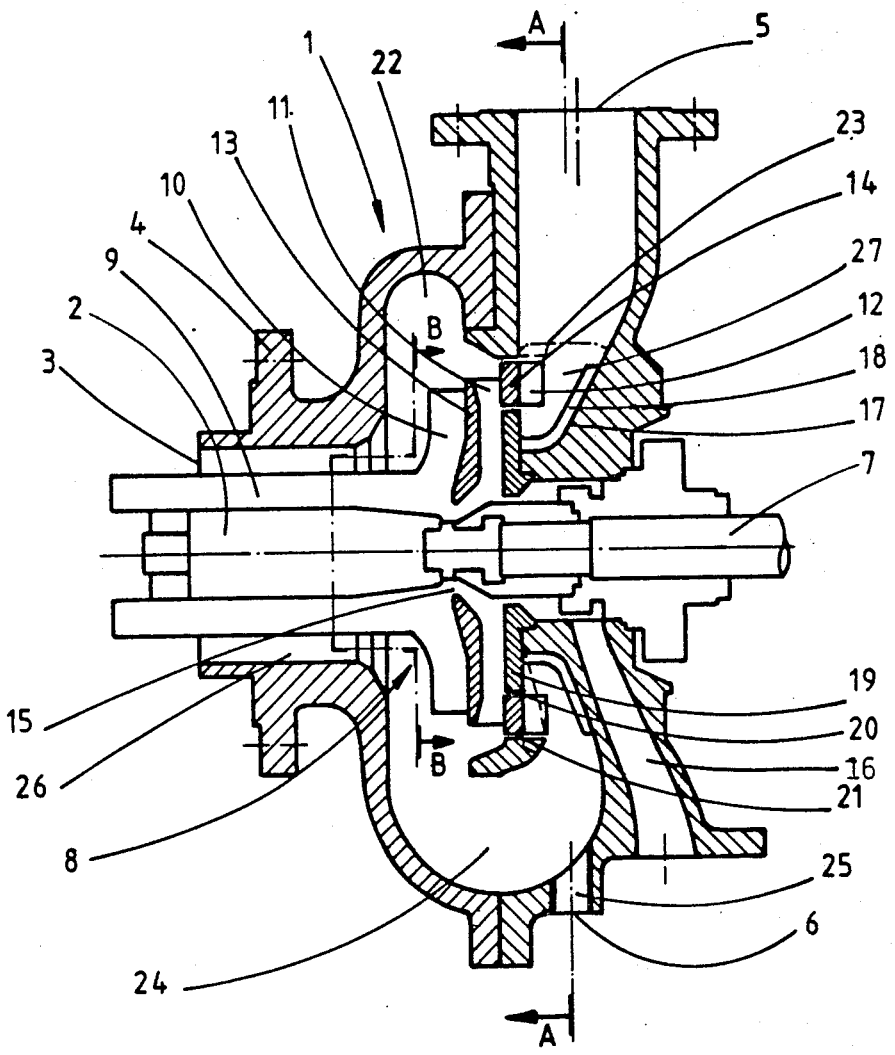
FIG. 1 is a cross section of an embodiment of the invention.
Figure 2:
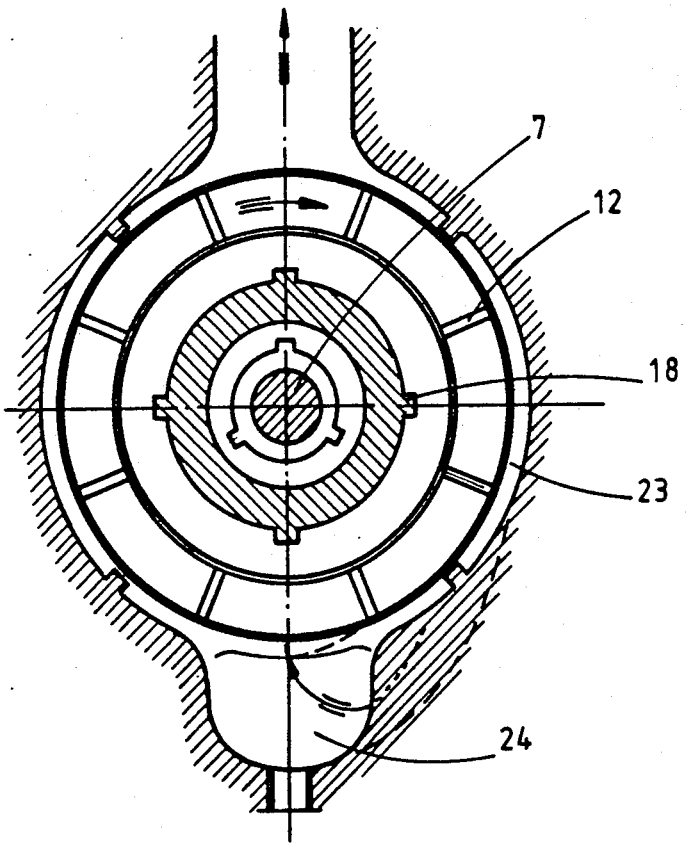
FIG. 2 is a section on line A—A in FIG. 1.
Figure 3:
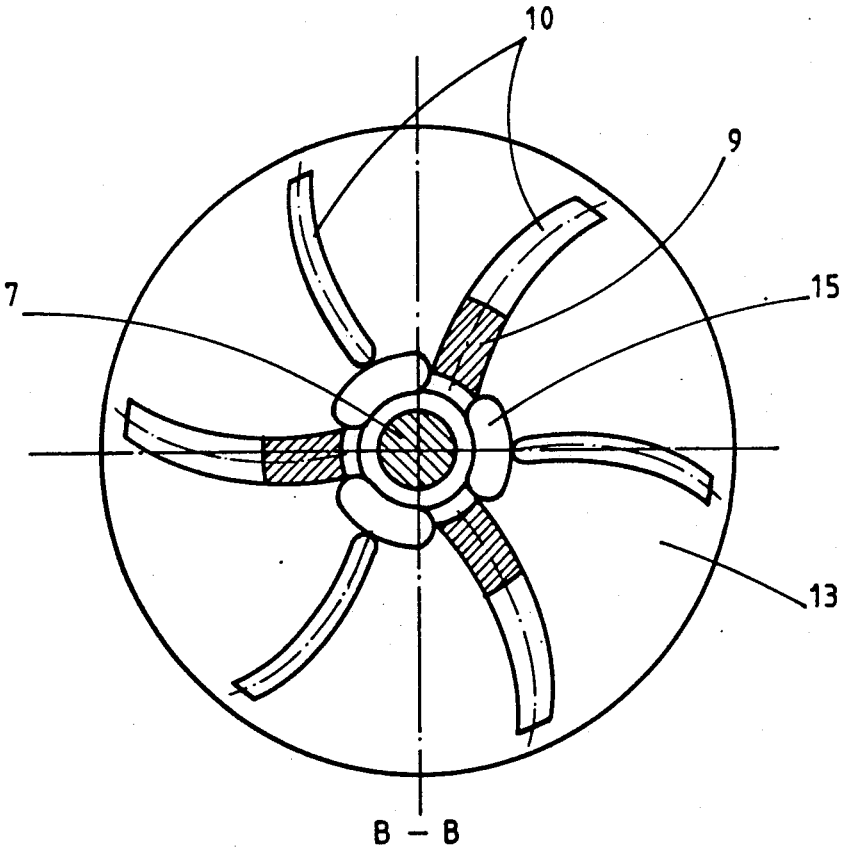
FIG. 3 is a section on line B—B in FIG. 1.

In the figures the reference numeral 1 refers to the apparatus casing which consists of two parts. The casing comprises a cylindrical inlet channel 2 into which the fibre suspension to be treated is fed through an inlet 3. The casing is provided with a flange 4 for fixing the apparatus to a vessel or any other source of fibre suspension. The casing also comprises another flange having an opening 5 for the discharge of the treated fibre material from the apparatus, and an inlet 6 for chemicals. The casing is equipped with a shaft 7 rotated by a motor, which is not illustrated in the figures, the shaft being sealed and journalled outside the casing in a way known per se and not illustrated in the figures. A rotor 8, which comprises blades 9, 10, 11 and 12 differing from each other in both structural configuration and function, and discs 13 and 14 between the blades 10 and 11, and 11 and 12 respectively, is fixed to the shaft. Rotor blades 9 in the inlet channel which constitute the fluidizing and gas separating section are substantially axial. When the rotor rotates, centrifugal force separates gas from the fibre suspension and an annular core of gas surrounded by a mixture of gas and liquid is created in the inlet channel. The inner rotor blades 10 constituting the pumping section of the rotor extend to a longer radial distance ($r_1$) from the axis than blades 9, which increases the pressure on the fibre suspension by centrifugal force.

Disc 13 comprises an opening or openings 15 through which the gas separated in the rotor section 0 can be discharged. The function of the blades 11 behind the disc is to separate the fibre material transported with the gas through openings 15, in order to minimize the amount of fibres in the gas discharged from the apparatus through channel 16.

The rotor blades 12 which constitute the chemical mixing section and are fixed to blades 11 behind the annular disc 14 are substantially radial. To intensify mixing, ribs 18 are disposed in a wall 17 of the casing close to the range of blades 12 which results in efficient mixing of the fibre suspension in zone 27 between the disc and the casing wall when the rotor rotates. Disc 14 is located between an outer surface 20 of a disc 19 disposed inside the casing around the shaft and a sealing surface 21 provided in the casing in such a way that a partition wall is formed dividing the casing in two chambers 22 and 23 which communicate with each other through a channel 24. The pumping section of the rotor is loacated in chamber 22 and the mixing section in chamber 23. For the supply of chemicals between the pumping section and the mixing section, at least one inlet 25, with its feed opening 6, leading to the channel 24, is provided in the casing.

The fibres suspension, from which gas has been removed in the gas separation zone 26 formed by the inlet channel and the rotor blades 9, flows through the pumping zone formed in the chamber 22 by the rotor blades 10 and the casing wall and is after that guided through the channel 24, in which chemicals are added to it, to the mixing zone 27 formed in the chamber 23 by the casing wall 17, which is provided with ribs, and the rotor blades 12, in which zone chemicals are evenly mixed in it after which the suspension is discharged through the opening 5.

The gaps between the rotor disc 14 and the sealing surfaces 20 and 21 are located so that the direction of the leakage flow is from the pumping zone to the mixing zone which prevents the chemicals from coming out through the gas discharge or the sealing box of the pump.

The invention is not limited to the embodiment presented here as an example, only, but it can be modified and applied in various ways within the scope of protection defined by the patent claims. E.g. the chemical supply opening 6 and the channel 24 connecting the chambers 22 and 23 can be located beside the discharge opening for the fibre suspension whereby the chemicals and the fibre suspension must flow in the influence range of the rotor blades 12 almost a whole cycle before they are discharged from the pump. The apparatus can be provided with several inlets at an angular distance from each other through which various chemicals can be introduced into the apparatus. Ungasifiable chemicals can be added to the apparatus also in the inlet channel 2. The form and dimensions of the blades can differ considerably from the ones illustrated in the drawings.

We claim:

1. An apparatus for mixing chemicals in a fiber suspension, the apparatus comprising a casing having a first inlet channel at one end thereof for receiving the fiber suspension; a second inlet for introducing chemicals to be mixed with the fiber suspension, a first outlet for discharging fiber suspension treated with the chemicals, and a second outlet for discharging gas separated from said fiber suspension; a rotor mounted for rotation within the casing, said rotor comprising a first blade configuration in a fluidizing and gas separation section located in the first inlet channel of said casing, a second blade configuration in a pumping section of said casing, downstream of said first blade configuration, and a third blade configuration in a chemical mixing section of said casing; said second inlet located downstream of said second blade configuration to introduce the chemicals in a channel provided in the casing connecting the pumping section and the mixing section.

2. An apparatus as recited in claim 1 wherein said casing includes a wall at least partially forming said mixing section, said wall being provided with ribs, said third blade configuration cooperating with said ribs to intensify the mixing of the chemicals with the fiber suspension.

3. An apparatus as recited in claim 1 wherein said rotor is mounted for rotation on a longitudinal shaft, said first blade configuration extending substantially axially relative to said shaft, said second and third blade configurations extending substantially radially relative to said shaft.

4. An apparatus as recited in claim 1 wherein said casing is divided into two chambers, the pumping section being located in one chamber, and the mixing section located in the other chamber, said chambers being interconnected by said channel.

5. An apparatus as defined in claim 1 wherein said rotor includes a fourth blade configuration located between said second and third blade configurations.

6. An apparatus for mixing chemicals in a fiber suspension, the apparatus comprising a casing having a first inlet channel at one end thereof for receiving the fiber suspension; a second inlet for introducing chemicals to be mixed with the fiber suspension, a first outlet for discharging fiber suspension treated with the chemicals, and a second outlet for discharging gas separated from said fiber suspension; a rotor mounted for rotation within the casing, said rotor comprising a first blade configuration in a fluidizing and gas separation section of said casing, a second blade configuration in a pumping section of said casing, a third blade configuration in a chemical mixing section of said casing, and a fourth blade configuration located between said second and third blade configurations, wherein said second inlet is located to introduce the chemicals in a channel provided in the casing connecting the pumping section and the mixing section, and wherein a first rotor disc is located between said second and fourth blade configurations, said disc provided with openings through which gas separated in the fluidizing and gas separation section of the casing passes to said second outlet.

7. An apparatus as defined in claim 6 wherein a second rotor disc is located between said fourth and third blade configurations, and a third rotor disc is mounted on said shaft and located radially inwardly of said second rotor disc, wherein said second and third rotor discs comprise a partition wall which divides the casing into two chambers interconnected by said channel, and wherein said pumping section is in one of said chambers, and said mixing section is in another of said chambers.

* * * * *

UNITED STATES PATENT AND TRADEMARK OFFICE

CERTIFICATE OF CORRECTION

PATENT NO. : 4,834,547

DATED : May 30, 1989

INVENTOR(S) : NISKANEN

It is certified that error appears in the above-identified patent and that said Letters Patent is hereby corrected as shown below:

On the cover sheet, the Assignee should read:
Kamyr AB, Karlstad, Sweden

Signed and Sealed this

Fifth Day of June, 1990

*Attest:*

HARRY F. MANBECK, JR.

*Attesting Officer*

*Commissioner of Patents and Trademarks*